US007195470B2

(12) United States Patent
Kimura et al.

(10) Patent No.: US 7,195,470 B2
(45) Date of Patent: Mar. 27, 2007

(54) SCROLL COMPRESSOR HAVING A SUPPLY PASSAGE CONNECTING THE BACK PRESSURE CHAMBER TO DISCHARGE PRESSURE REGION AND PASSING A CLEARANCE AT A SLIDING PORTION

(75) Inventors: Kazuya Kimura, Kariya (JP); Izuru Shimizu, Kariya (JP); Susumu Tarao, Kariya (JP); Yumin Hishinuma, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 9 days.

(21) Appl. No.: 11/015,996

(22) Filed: Dec. 16, 2004

(65) Prior Publication Data

US 2005/0135956 A1 Jun. 23, 2005

(30) Foreign Application Priority Data

Dec. 19, 2003 (JP) ..... 2003-423582

(51) Int. Cl.
*F03C 2/00* (2006.01)
*F04C 18/00* (2006.01)

(52) U.S. Cl. ..... 418/55.5; 418/55.1; 418/55.6; 418/57; 418/89; 418/96; 418/DIG. 1

(58) Field of Classification Search ..... 418/55.1–55.5, 418/57, 89, 96, 100, DIG. 1; 184/6.17, 6.16
See application file for complete search history.

(56) References Cited

U.S. PATENT DOCUMENTS 5,989,000 A 11/1999 Tomayko et al.
6,227,831 B1 5/2001 Osima et al.
6,749,404 B2 6/2004 Gennami et al.
6,872,063 B2 * 3/2005 Kimura et al. ..... 418/55.5

FOREIGN PATENT DOCUMENTS

EP 1 172 562 1/2002
EP 1 365 152 11/2003
JP 61098987 A * 5/1986

(Continued)

OTHER PUBLICATIONS

Chinese Office Action dated Jan. 5, 2007 for Chinese Patent Application No. 2004100820897 with English translation.

*Primary Examiner*—Theresa Trieu
(74) *Attorney, Agent, or Firm*—Morgan & Finnegan, L.L.P.

(57) ABSTRACT

A scroll type compressor includes a housing defining a discharge pressure region, a fixed scroll member having a fixed base plate and a fixed scroll wall, a movable scroll member having a movable base plate and a movable scroll wall, a fixed wall slidably supporting the movable scroll member, a back pressure chamber defined on a back surface side of the movable base plate. A supply passage connects the back pressure chamber to the discharge pressure region and passes through a sliding portion between the movable scroll member and the fixed wall. A clearance at the sliding portion varies in response to a position of the movable scroll member in a direction in which the movable scroll member approaches to or leaves from the fixed wall, whereby cross-sectional area of the clearance where gas passes is varied to adjust pressure in the back pressure chamber.

14 Claims, 3 Drawing Sheets

FOREIGN PATENT DOCUMENTS

| | | | | |
|---|---|---|---|---|
| JP | 61-118580 | | 6/1986 | |
| JP | 61205386 A | * | 9/1986 | |
| JP | 64-44385 | | 3/1989 | |
| JP | 03064686 A | * | 3/1991 | ..... 418/55.5 |
| JP | 5-001677 | | 1/1993 | |
| JP | 05288166 A | * | 11/1993 | |
| JP | 2001-304144 | | 10/2001 | |
| WO | WO 2004010001 A1 | * | 1/2004 | |

* cited by examiner

SCROLL COMPRESSOR HAVING A SUPPLY PASSAGE CONNECTING THE BACK PRESSURE CHAMBER TO DISCHARGE PRESSURE REGION AND PASSING A CLEARANCE AT A SLIDING PORTION

BACKGROUND OF THE INVENTION

The present invention relates to a scroll type compressor for compressing refrigerant, which is a part of a refrigerant circuit of an air conditioner.

In such a scroll type compressor, the housing includes a fixed scroll member, which has a fixed base plate and a fixed scroll wall that extends from the fixed base plate, and a movable scroll member, which has a movable base plate and a movable scroll wall that extends from the movable base plate and engages with the fixed scroll wall. By the orbital motion of the movable scroll member with the self-rotation thereof being blocked, compression chambers defined between the fixed scroll wall and the movable scroll wall move radially and inwardly to progressively reduce their volumes, thus compressing refrigerant gas.

Recently, carbon dioxide has generally been employed as refrigerant for the refrigerant circuit. Pressure in the refrigerant circuit when employing carbon dioxide as refrigerant is higher than that when employing fluorocarbon as refrigerant. Accordingly, in a scroll type compressor, unusually large thrust force is applied to the movable scroll member based upon the high pressure in the compression chamber. Then, the movable scroll member slides under the hard condition, and durability of the scroll type compressor is deteriorated.

In order to solve such problems, according to pages 4 and 5, and FIG. 1 of Unexamined Japanese Patent Publication No. 2000-249086, the movable scroll member forms a recess on its back surface of the movable base plate, and the recess is closed by a fixed wall on the back surface side provided in the housing, thus defining a back pressure chamber. The compression chamber during volume-reducing process is in communication with the back pressure chamber through a supply passage. High-pressure refrigerant gas is introduced from the compression chamber into the back pressure chamber through the supply passage. In the movable scroll member, a check valve is arranged in the supply passage for blocking the refrigerant gas from back-flowing from the back pressure chamber to the compression chamber.

Accordingly, the pressure in the back pressure chamber applies back pressure force, which opposes thrust force based upon the pressure in the compression chamber, to the movable scroll member. Thus, sliding resistance is reduced between the movable base plate of the movable scroll member and the fixed wall on the back surface side, on which the back surface of the movable base plate slides.

The pressure in the back pressure chamber, that is, the back pressure force applied to the movable scroll member, is appropriately adjusted so that the clearance (passing cross-sectional area of the refrigerant gas) between the movable base plate of the movable scroll member and the fixed wall on the back surface side varies. In other words, for example, as the pressure in the compression chamber rises, the thrust force applied to the movable scroll member increases, with the result of the minimum (zero) clearance between the movable base plate and the fixed wall on the back surface side. Accordingly, the refrigerant gas is blocked from being bled from the back pressure chamber to the suction pressure region through the clearance, and the pressure in the back pressure chamber, that is, the back pressure force applied to the movable scroll member tends to increase.

On the contrary, as the pressure in the compression chamber falls, the thrust force applied to the movable scroll member decreases, with the result of the increased clearance between the movable base plate and the fixed wall on the back surface side. Accordingly, the amount of refrigerant gas bled from the back pressure chamber to the suction pressure region through the clearance increases, and the pressure in the back pressure chamber, that is, the back pressure force applied to the movable scroll member tends to decrease.

Then, the valve-opening operation of the check valve bleeds the refrigerant gas in the back pressure chamber to the suction pressure region before the high-pressure refrigerant gas in the compression chamber is bled to the back pressure chamber. Accordingly, the movable scroll member instantaneously contacts the fixed wall on the back surface side with its movable base plate by the thrust force, so that the high-pressure refrigerant gas in the compression chamber, that is, the refrigerant gas that has finished its compression work is prevented from uselessly flowing out to the suction pressure region through the supply passage and the back pressure chamber. This leads to improved efficiency of the scroll type compressor.

In the Unexamined Japanese Patent Publication No. 2000-249086, in addition to the clearance (a portion that functions as a valve) between the movable base plate and the fixed wall on the back surface side, the check valve needs to be arranged in the supply passage in the movable scroll member, therefore, there has particularly been a problem that it needs much effort to assemble the check valve to the movable scroll member. That is, in the Unexamined Japanese Patent Publication No. 2000-249086 with the complicated valve structure for adjusting the back pressure, there has been a problem that it needs much cost and work for manufacturing a scroll type compressor. Therefore, there is a need for providing a scroll type compressor that has a simple valve structure for adjusting back pressure force.

SUMMARY OF THE INVENTION

In accordance with the present invention, a scroll type compressor comprising a housing, a fixed scroll member, a movable scroll member, a first fixed wall, a back pressure chamber, and a supply passage. The housing defines a discharge pressure region. The fixed scroll member has a fixed base plate and a fixed scroll wall extending from a surface of the fixed base plate. The movable scroll member has a movable base plate and a movable scroll wall extending from a surface of the movable base plate. The movable scroll wall is engaged with the fixed scroll wall. The fixed scroll member and the movable scroll member are arranged in the housing and define therebetween a compression chamber, which moves radially and inwardly to progressively reduce the volume of the compression chamber for compressing gas by orbital motion of the movable scroll member. The first fixed wall is provided in the housing for slidably supporting a surface of the movable scroll member. The back pressure chamber is defined on a back surface side of the movable base plate in the housing. The supply passage connects the back pressure chamber to the discharge pressure region and passes through a sliding portion between the movable scroll member and the first fixed wall, wherein a clearance at the sliding portion varies in response to a position of the movable scroll member in a direction in which the movable scroll member approaches to or leaves from the first fixed wall, whereby cross-sectional area of the clearance where the gas passes is varied to adjust pressure in the back pressure chamber.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A preferred embodiment in which a scroll type compressor according to the present invention is applied to a motor compressor for use in a refrigerant circuit of a vehicle air conditioner will now be described. It is noted that refrigerant for the refrigerant circuit employs carbon dioxide.

Figure 1:
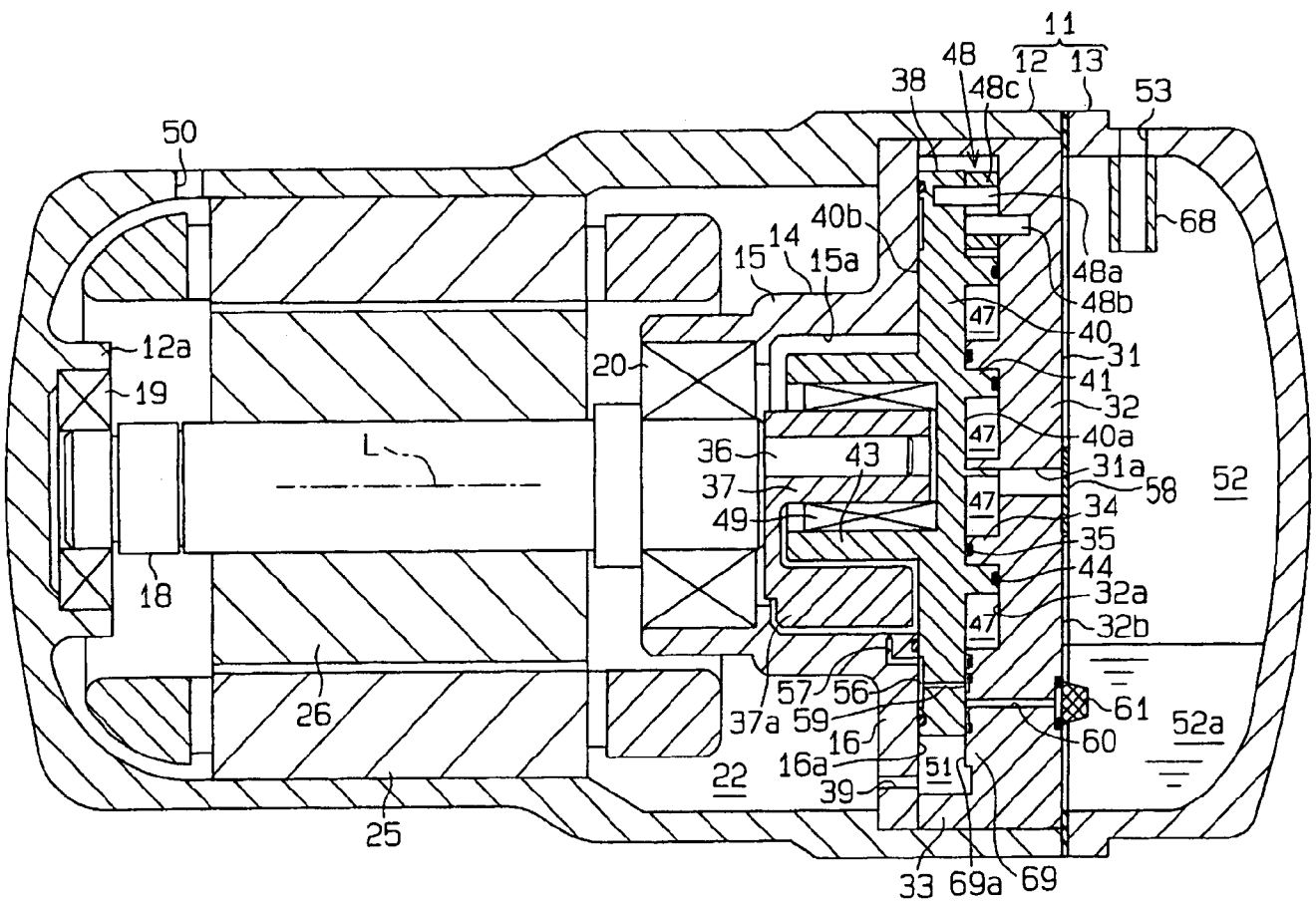
FIG. 1 is a longitudinal cross-sectional view of a motor compressor according to a preferred embodiment of the present invention.

As shown in FIG. 1, the motor compressor has a housing 11, which is made by fixedly connecting a first housing component 12 with a second housing component 13. The first housing component 12 has a cylindrical shape that has a bottom on the left side in FIG. 1. The second housing component 13 has a cylindrical shape that has a bottom on the right side in FIG. 1.

The first housing component 12 has a cylindrical shaft support portion 12*a*, which is integrally formed on the bottom center of the inner wall surface of the first housing component 12. The first housing component 12 fixedly accommodates a shaft support member 14 at the opening end thereof. The shaft support member 14 includes a cylindrical portion 15 at the center, which forms therein a hole 15*a*, and a flange-like disc-shaped portion or a second fixed wall 16, which is formed at the right end of the cylindrical portion 15 in FIG. 1.

The first housing component 12 accommodates a rotary shaft 18. The rotary shaft 18 is rotatably supported at its left end by a bearing 19, which is placed in the shaft support portion 12*a*, and is accommodated and rotatably supported at its right end in the hole 15*a* of the cylindrical portion 15 of the shaft support member 14 by a bearing 20.

The housing 11 forms therein a motor chamber 22 in a region at the left side in FIG. 1 with respect to the shaft support member 14. In the motor chamber 22, a stator 25 is fixed to the inner cylindrical surface of the first housing component 12, and a rotor 26 is secured to the rotary shaft 18 and located radially inside the stator 25. The stator 25 and the rotor 26 cooperate to form an electric motor. Accordingly, as the stator 25 is externally supplied with electric current, the rotor 26 and the rotary shaft 18 are integrally rotated.

A fixed scroll member 31 is accommodated in the first housing component 12 and located on the right side with respect to the shaft support member 14 in FIG. 1. The fixed scroll member 31 has a disc-shaped fixed base plate 32. A cylindrical outer peripheral wall 33 extends from the outermost peripheral portion of a front surface 32*a* of the fixed base plate 32. A fixed scroll wall 34 extends from the radially inner portion of the front surface 32*a* of the fixed base plate 32 with respect to the outer peripheral wall 33. A tip seal 35 is provided on the distal end surface of the fixed scroll wall 34. The fixed scroll member 31 is fixedly connected at the end surface of the outer peripheral wall 33 to the outermost peripheral portion of the disc-shaped portion 16 of the shaft support member 14.

A crankshaft 36 is formed on the right end surface of the rotary shaft 18 and accommodated in the right side of the shaft support member 14 and is offset from the axis L of the rotary shaft 18. A bushing 37 is fixedly fitted around the crankshaft 36. A bearing 49 is supported on the bushing 37. A movable scroll member 38 is supported on the bearing 49. A balancer 37*a* is provided on one end of the bushing 37 on the side of the bearing 20. The balancer 37*a* reduces rotational imbalance of the rotary shaft 18 due to the offset arrangement of the movable scroll member 38 around the axis L.

The movable scroll member 38 has a disc-shaped movable base plate 40 and a movable scroll wall 41 that extends from a front surface 40*a* of the movable base plate 40 toward the fixed base plate 32. A tip seal 44 is provided on the distal end surface of the movable scroll wall 41. The movable scroll member 38 has a boss 43 that extends from the center of a back surface 40*b* of the movable base plate 40. The boss 43 is fitted around the bearing 49 on the bushing 37. The movable base plate 40 slidably contacts the back surface 16*a* of the disc-shaped portion 16 (or a second fixed wall) of the shaft support member 14 at its outer peripheral portion of the back surface 40*b*.

The fixed scroll member 31 and the movable scroll member 38 are engaged with each other by their scroll walls 34, 41, and slidably contact at their end surfaces of the scroll walls 34, 41 with the base plates 40, 32 of the opposing scroll members 38, 31, respectively. Accordingly, The fixed scroll member 31 and the movable scroll member 38 define therebetween compression chambers 47 by their base plates 32, 40 and scroll walls 34, 41. Incidentally, in the movable and fixed scroll members 38, 31, "front" is the facing side of the compression chambers 47 and "back" is the opposite side of the compression chambers 47.

A plurality of self-rotation blocking mechanisms 48 (only one of them shown in FIG. 1) are provided between the front surface 40*a* of the movable base plate 40 of the movable scroll member 38 and the front surface 32*a* of the fixed base plate 32 of the fixed scroll member 31. Each of the self-rotation blocking mechanisms 48 includes a pair of pins 48*a*, 48*b*, and a ring 48*c*. One pin 48*a* is fixed to the outermost peripheral portion of the front surface 40*a* in the movable base plate 40. The other pin 48*b* is fixed to the outer peripheral portion (which is inside the outer peripheral wall 32) of the front surface 32*a* of the fixed base plate 32. The ring 48*c* is located outside the pins 48*a*, 48*b* to prevent the pins 48*a*, 48*b* from being radially spaced away from each other.

The outer peripheral wall 33 of the fixed scroll member 31 and the outermost peripheral portion of the movable scroll wall 41 of the movable scroll member 38 define therebetween a suction chamber 51. The outer peripheral portion of the disc-shaped portion 16 of the shaft support member 14 forms therein a suction port 39 that connects the suction chamber 51 to the motor chamber 22. The first housing component 12 forms therein an inlet 50 that communicates with the motor chamber 22. An external conduit that connects with the outlet of an evaporator of an external refrigerant circuit (not shown) is connected to the inlet 50. Accordingly, low-pressure refrigerant gas from the external refrigerant circuit is introduced into the suction chamber 51 through the inlet 50, the motor chamber 22, and the suction port 39.

The second housing component 13 and the fixed scroll member 31 define therebetween a discharge chamber 52 in the housing 11. The fixed scroll member 31 forms a discharge port 31 a at the center of the fixed base plate 32 thereof. In the discharge chamber 52, a discharge valve 58 made of a flapper valve is attached to the back surface 32*b* of the fixed base plate 32 of the fixed scroll member 31. The innermost compression chamber 47 communicates with the discharge chamber 52 through the discharge port 31*a*. The second housing component 13 forms therein an outlet 53 that communicates with the discharge chamber 52.

In the discharge chamber 52, a separation pipe 68 is attached to the opening of the outlet 53. The separation pipe 68, for example, prevents lubricating oil (refrigerating machine oil) in the discharge chamber 52 from flowing to the outlet 53 along the inner wall surface of the discharge chamber 52, thus functioning as a kind of oil separator. An external conduit, which connects with the inlet of a gas cooler of the external refrigerant circuit (not shown), is connected to the outlet 53 outside the second housing component 13. Accordingly, the refrigerant gas in the discharge chamber 52 is bled to the external refrigerant circuit through the separation pipe 68 and the outlet 53.

As the rotary shaft 18 is rotated, the movable scroll member 38 is orbited around the axis (the axis L of the rotary shaft 18) of the fixed scroll member 31 through the crankshaft 36. At the same time, the self-rotation blocking mechanism 48 blocks the self-rotating motion of the movable scroll member 38, and only the orbital motion thereof is permitted. By the orbital motion of the movable scroll member 38, the compression chambers 47 progressively reduce their volumes as they move radially and inwardly from the outer peripheral side of the scroll walls 34, 41 of the scroll members 31, 38 toward the center thereof, thus compressing the low-pressure refrigerant gas, which is introduced into the compression chamber 47 from the suction chamber 51. The high-pressure refrigerant gas, which has been compressed, is discharged from the innermost compression chamber 47 to the discharge chamber 52 through the discharge port 31*a* by pushing away the discharge valve 58.

The adjustment function for the back pressure force applied to the movable scroll member 38 will now be described.

Figure 2:
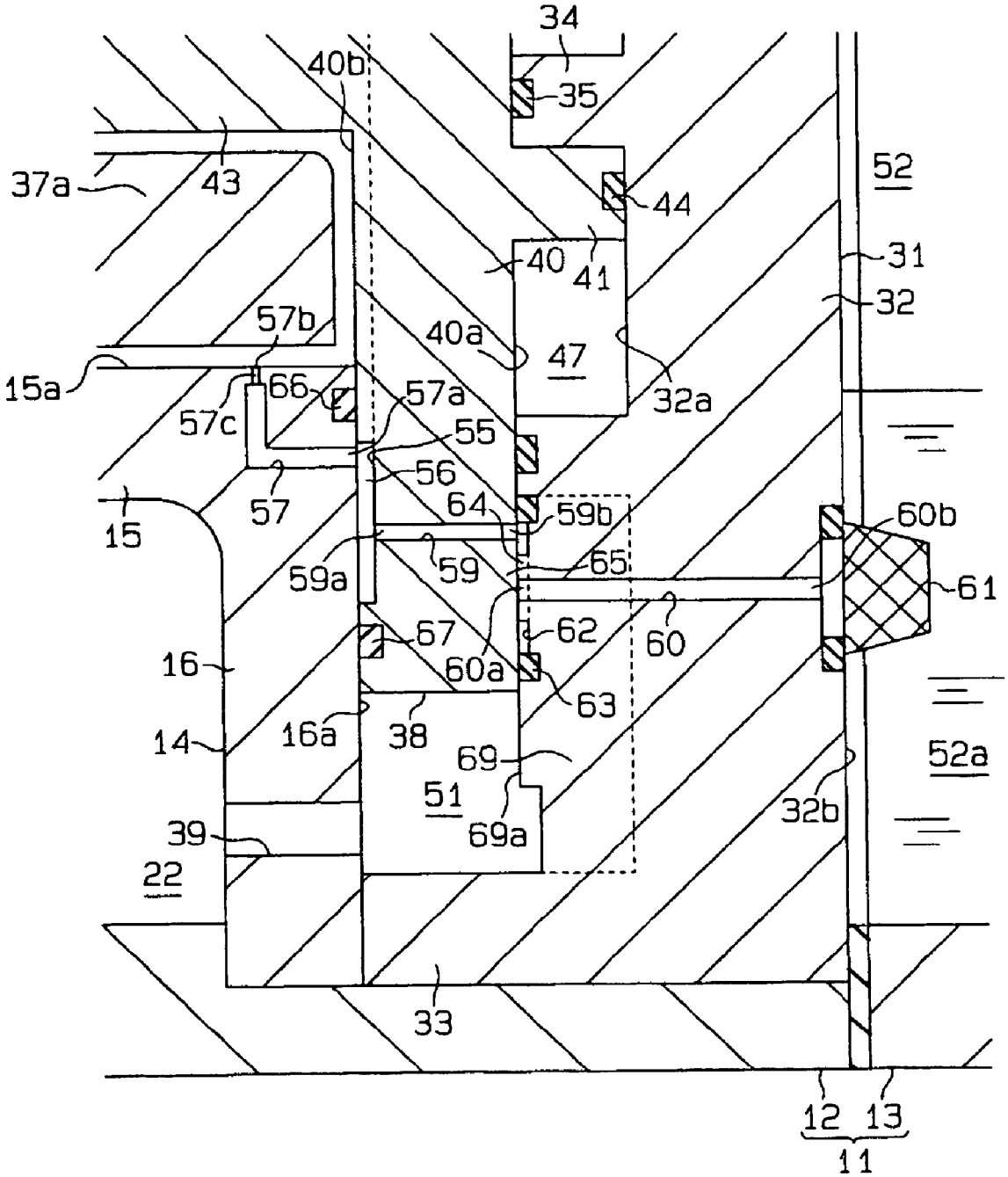
FIG. 2 is a partially enlarged cross-sectional view of FIG. 1.
Figure 3:
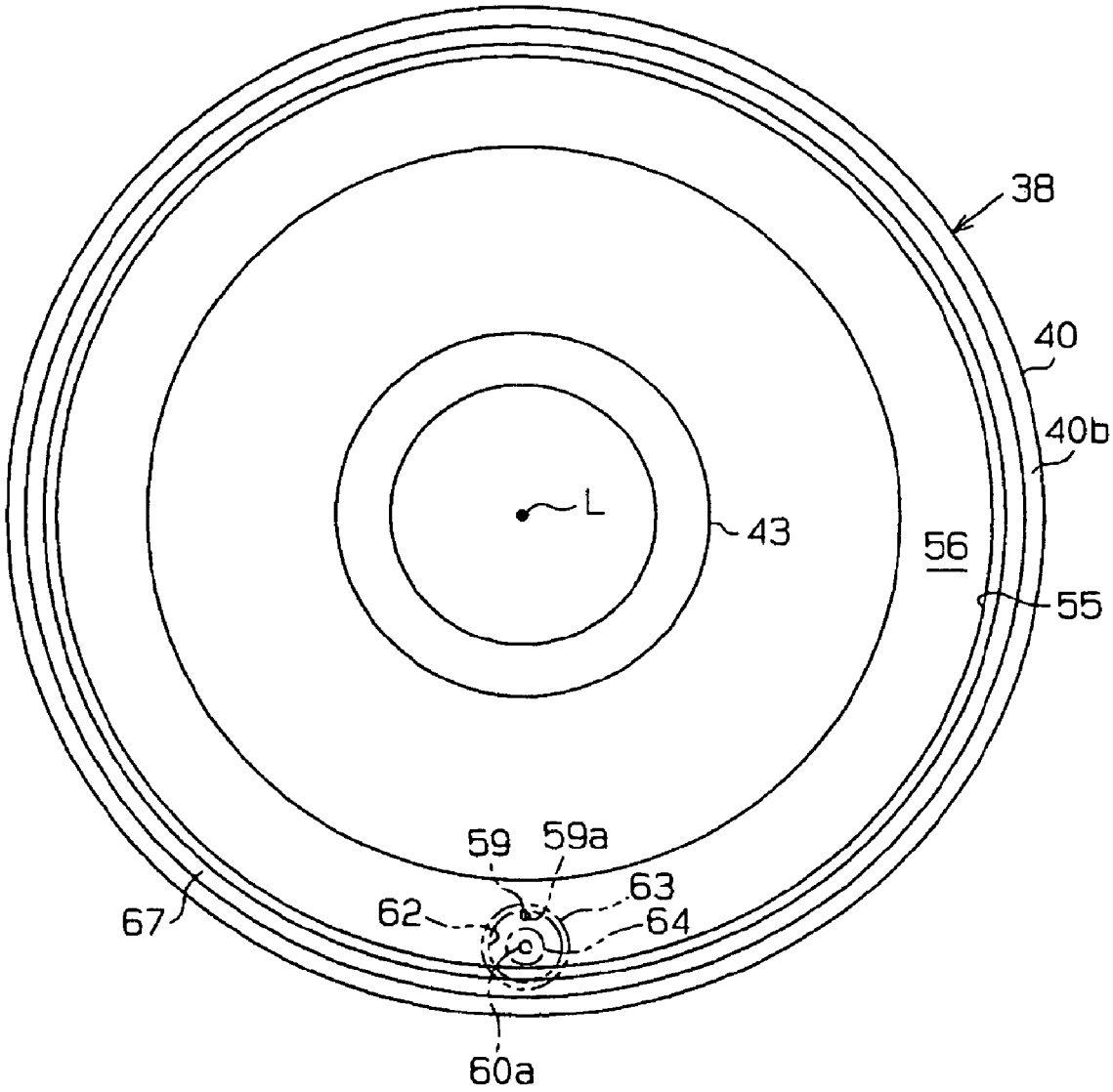
FIG. 3 is a back view of a movable scroll member according to the preferred embodiment of the present invention.

As shown in FIGS. 2 and 3, in the movable base plate 40 of the movable scroll member 38, an annular recess 55 is recessed on the outer peripheral portion of the back surface 40*b* in the annular region along the outline circle of the movable base plate 40. The annular recess 55 is closed by the back surface 16*a* of the disc-shaped portion 16 of the shaft support member 14. Accordingly, the back surface 40*b* of the movable base plate 40 and the back surface 16*a* of the disc-shaped portion 16 of the shaft support member 14, which form therebetween an inner space of the annular recess 55 that is closed by the disc-shaped portion 16, define a back pressure chamber 56.

As shown in FIG. 2, in the shaft support member 14, an inner tip seal 66 is provided radially inward with respect to the back pressure chamber 56 on the back surface 16*a* of the disc-shaped portion 16. In the movable scroll member 38, an outer tip seal 67 is provided radially outward with respect to the back pressure chamber 56 on the back surface 40*b* of the movable base plate 40. The inner tip seal 66 slidably contacts the back surface 40*b* of the movable base plate 40, and the outer tip seal 67 slidably contacts the back surface 16*a* of the disc-shaped portion 16 of the shaft support member 14, so that the back pressure chamber 56 is sealed from the ambient atmosphere.

The shaft support member 14 forms therein a bleed passage 57 that coordinates with the back pressure chamber 56. The bleed passage 57 opens at its one end (an opening 57*a*) at the back surface 16*a* of the disc-shaped portion 16 of the shaft support member 14 to communicate with the back pressure chamber 56, and opens at its other end (an opening 57*b*) into the hole 15*a* of the cylindrical portion 15 of the shaft support member 14. The hole 15*a* of the cylindrical portion 15 communicates with the motor chamber 22 (shown in FIG. 1) to have the same atmospheric pressure as the motor chamber 22, that is, the hole 15*a* is a part of a suction pressure region. In the bleed passage 57, a fixed throttle 57*c* is provided between the opening 57*b* and the hole 15*a*.

In the movable scroll member 38, a movable passage 59 is formed around the lowermost portion of the movable base plate 40 to coordinate with the back pressure chamber 56. The movable passage 59 opens at its one end (an opening 59*a*) into the back pressure chamber 56, and opens at its other end (an opening 59*b*) at the front surface 40*a* of the movable base plate 40. In the fixed scroll member 31, a fixed passage 60 is formed around the lowermost portion of the fixed base plate 32 to coordinate with the movable passage 59.

In the fixed base plate 32 of the fixed scroll member 31, a first fixed wall 69, which is formed to face the front surface 40*a* of the movable base plate 40, is located radially inside the outer peripheral wall 33 and radially outside the fixed scroll wall 34 around the lowermost portion of the fixed base plate 32. That is, the first fixed wall 69 is provided at a portion of the front surface 32*a* of the fixed base plate 32 that is different from the fixed scroll wall 34. An end surface 69*a* of the first fixed wall 69 and the front surface 40*a* of the movable base plate 40 slidably contact each other (a sliding portion between the movable scroll member 38 and the first fixed wall 69).

The fixed passage 60 extends through the first fixed wall 69 from the fixed base plate 32 toward the movable base plate 40. The fixed passage 60 opens at its one end (an opening 60*a*) on the end surface 69*a* of the first fixed wall 69, and opens at its other end (an opening 60*b*) around the lowermost portion of the back surface 32*b* of the fixed base plate 32, that is, around the lowermost portion in the discharge chamber 52.

The lubricating oil, which is separated from the refrigerant gas by the separation pipe 68, drops to be reserved around the lowermost portion of the discharge chamber 52. That is, the region around the lowermost portion in the discharge chamber 52 is regarded as a reservoir space 52*a* for reserving the lubricating oil that is separated by the separation pipe 68. In the reservoir space 52*a*, a filter 61 is provided at the opening 60*b* of the fixed passage 60 on the back surface 32*b* of the fixed base plate 32 of the fixed scroll member 31. The filter 61 is to remove foreign substances from the lubricating oil that flows from the reservoir space 52*a* to the fixed passage 60.

On the end surface 69*a* of the first fixed wall 69 of the fixed scroll member 31, a communication recess 62 is formed around the opening 60*a* of the fixed passage 60. The communication recess 62 has an annular shape that extends along a locus that the opening 59*b* of the movable passage 59 tracks by the orbital motion of the movable scroll member 38. Accordingly, the opening 59*b* of the movable passage 59 constantly faces the communication recess 62 even if the movable scroll member 38 is located at any orbital position. The fixed passage 60, the communication recess 62 and the movable passage 59 cooperate to form a supply passage that connects the discharge chamber or a discharge pressure region 52 (the reservoir space 52*a*) to the back pressure chamber 56.

On the end surface 69*a* of the first fixed wall 69 of the fixed scroll member 31, a tip seal 63 is placed around the communication recess 62 to slidably contact the front surface 40*a* of the movable base plate 40 of the movable scroll member 38. The communication recess 62 and the opening 59*b* of the movable passage 59 are in communication with each other inside the tip seal 63, that is, in a state where they are sealed by the tip seal 63 from the ambient atmosphere. This leads to prevented leakage of high-pressure refrigerant gas from the supply passage, that is, prevented decrease in efficiency of the motor compressor.

On the end surface 69*a* of the first fixed wall 69 of the fixed scroll member 31, a region around the opening 60*a* of the fixed passage 60 and surrounded by the communication recess 62 functions as a valve seat 64. On the end surface 69*a* of the first fixed wall 69, a region around the opening 59*b* of the movable passage 59 and facing the valve seat 64 functions as a valve portion 65.

As the movable scroll member 38 (the movable base plate 40) moves away from the fixed scroll member 31 (the first fixed wall 69) with respect to the direction along the axis L of the rotary shaft 18, the valve portion 65 leaves from the valve seat 64 to increase the clearance therebetween. On the contrary, as the movable scroll member 38 moves to approach the fixed scroll member 31, the valve portion 65 approaches the valve seat 64 to reduce the clearance therebetween.

As the pressure in the discharge chamber 52 rises by starting the operation of the motor compressor, the high-pressure refrigerant gas in the discharge chamber 52 is introduced into the back pressure chamber 56 through the fixed passage 60, the communication recess 62, and the movable passage 59. The refrigerant gas in the back pressure chamber 56 is bled to the motor chamber 22 through the bleed passage 57 and the hole 15*a*. The pressure in the back pressure chamber 56 is determined based upon the balance between the amount of high-pressure refrigerant gas from the discharge chamber 52 into the back pressure chamber 56 and the amount of refrigerant gas bled through the bleed passage 57.

The back pressure force is applied to the movable scroll member 38 based upon the pressure in the back pressure chamber 56 to urge the movable scroll member 38 toward the fixed scroll member 31 in the direction along the axis L. The thrust force is applied to the movable scroll member 38 based upon the pressure in the compression chamber 47 in the direction away from the fixed scroll member 31 along the axis L. Thus, in response to the balance between the back pressure force and the thrust force, a position of the movable scroll member 38 relative to the fixed scroll member 31 in the direction along the axis L is determined.

For example, as the pressure in the compression chamber 47 reduces to let the thrust force be below the back pressure force, the back surface 40*b* of the movable base plate 40 of the movable scroll member 38 is moved by the back pressure force away from the back surface 16*a* of the disc-shaped portion 16 of the shaft support member 14. The movable base plate 40 of the movable scroll member 38 leaves away from the disc-shaped portion 16, and the front surface 40*a* of the movable base plate 40 contacts with the end surface 69*a* of the first fixed wall 69 of the fixed scroll member 31, thus the clearance between the valve seat 64 and the valve portion 65 becomes minimum (zero).

As the clearance between the valve seat 64 and the valve portion 65 becomes minimum, the passing cross-sectional area of refrigerant gas between the fixed passage 60 and the communication recess 62, that is, the opening degree of the supply passage, becomes minimum (zero). Accordingly, the high-pressure refrigerant gas is prevented from being introduced from the discharge chamber 52 to the back pressure chamber 56 through the fixed passage 60, the communication recess 62, and the movable passage 59. Then, the pressure in the back pressure chamber 56 tends to fall, and the back pressure force applied to the movable scroll member 38 reduces.

For reducing the back pressure force applied to the movable scroll member 38, the clearance between the valve seat 64 and the valve portion 65 becomes minimum to prevent the high-pressure refrigerant gas from being introduced from the discharge chamber 52 to the back pressure chamber 56. Accordingly, the high-pressure refrigerant gas in the discharge chamber 52, that is, the compressed refrigerant gas, is prevented from uselessly flowing to the motor chamber 22 through the supply passage, the back pressure chamber 56 and the bleed passage 57. This leads to improved performance of the motor compressor.

As the thrust force exceeds the back pressure force due to increase in pressure in the compression chamber 47, the movable scroll member 38 is moved by the thrust force in the direction in which the back surface 40*b* of the movable base plate 40 approaches the back surface 16*a* of the disc-shaped portion 16 of the shaft support member 14. As the front surface 40*a* of the movable base plate 40 leaves away from the end surface 69*a* of the first fixed wall 69 of the fixed scroll member 31 so that the movable base plate 40 of the movable scroll member 38 contacts the disc-shaped portion 16 of the shaft support member 14, the clearance between the valve seat 64 and the valve portion 65 becomes maximum.

As the clearance between the valve seat 64 and the valve portion 65 becomes maximum, the passing cross-sectional area of the refrigerant gas between the fixed passage 60 and the communication recess 62, that is, the opening degree of the supply passage becomes maximum. Accordingly, the high-pressure refrigerant gas is introduced from the discharge chamber 52 to the back pressure chamber 56 through the fixed passage 60, the communication recess 62 and the movable passage 59. Thus, the pressure in the back pressure chamber tends to increase, and the back pressure force applied to the movable scroll member 38 increases.

At the same time, the refrigerant gas is slowly bled from the back pressure chamber 56 to the motor chamber 22 through the bleed passage 57 due to the fixed throttle 57*c* in the bleed passage 57. Accordingly, the high-pressure refrigerant gas in the discharge chamber 52, that is, the compressed refrigerant gas is prevented from uselessly flowing to the motor chamber 22 through the supply passage, the back pressure chamber 56 and the bleed passage 57. This leads to improved performance of the motor compressor.

As described above, the movable scroll member 38 varies the clearance between the front surface 40*a* of the movable base plate 40 and the end surface 69*a* of the first fixed wall 69 of the fixed scroll member 31 (the clearance between the valve seat 64 and the valve portion 65) so that the back pressure force based upon the pressure in the back pressure chamber 56 becomes an appropriate value in response to the thrust force based upon the pressure in the compression chambers 47, thus autonomously adjusting the pressure in the back pressure chamber 56. As the pressure in the back pressure chamber 56 is appropriately adjusted, generation of sliding resistance due to the orbital motion of the movable scroll member 38 is reduced.

According to the preferred embodiment, the following advantageous effects are obtained.

(1) To adjust the pressure in the back pressure chamber 56, that is, to adjust the back pressure force applied to the movable scroll member 38, the opening degree of the supply passage (the fixed passage 60, the movable passage 59, and the communication recess 62) is adjusted by varying the clearance at the sliding portion between the movable scroll member 38 and the first fixed wall 69. Accordingly, to decrease the back pressure force applied to the movable scroll member 38, the introduction of the high-pressure refrigerant gas from the discharge chamber 52 to the back pressure chamber 56 is prevented by minimizing clearance at the sliding portion between the movable scroll member 38 and the first fixed wall 69. Thus, for example, the check valve disclosed in Unexamined Japanese Patent Publication No. 2000-249086 is not required for closing the supply passage, so that the valve structure for adjusting the back pressure force is simple, and costs and processes are reduced for manufacturing the motor compressor.

(2) In the preferred embodiment, the front surface 40*a* of the movable base plate 40 is the front surface of the movable scroll member according to the present invention, and the first fixed wall 69 is provided on the front surface 32*a* of the fixed base plate 32 at a position that is different from the fixed scroll wall 34. That is, the first fixed wall 69 is provided in the fixed scroll member 31 exclusively for the supply passage and independently from the fixed base plate 32 and the fixed scroll wall 34. Accordingly, in comparison to employment of the radially thin fixed scroll wall 34 as a first fixed wall, or in comparison to employment of the region that slides on the movable scroll wall 41 in the fixed base plate 32 as a first fixed wall, the supply passage easily passes through the sliding portion between the movable scroll member 38 and the first fixed wall 69, that is, the arrangement of the supply passage (especially, the formation of the valve seat 64 and the valve portion 65) becomes easy.

(3) The back pressure chamber 56 is defined between the movable base plate 40 and the disc-shaped portion 16 of the shaft support member 14. The self-rotation blocking mechanism 48 is provided between the movable base plate 40 and the fixed base plate 32. In other words, the arrangement of the self-rotation blocking mechanism 48 between the movable base plate 40 and the fixed base plate 32 prevents a complicated space on the side of the back surface 40*b* of the movable base plate 40. Accordingly, the back pressure chamber 56 defined between the movable base plate 40 and the disc-shaped portion 16 of the shaft support member 14 becomes relatively free in arrangement and formation. Thus, in the preferred embodiment, the annular back pressure chamber 56 (the annular recess 55) is arranged along the outline of the movable base plate 40 at the outer peripheral portion of the back surface 40*b* of the movable base plate 40.

(4) Lubricating oil is introduced together with the high-pressure refrigerant gas from the region around the lowermost portion of the discharge chamber 52, that is, the reservoir space 52 for lubricating oil to the back pressure chamber 56. Accordingly, a sufficient amount of lubricating oil is supplied to, for example, the sliding portion between the movable base plate 40 of the movable scroll member 38 and the disc-shaped portion 16 of the shaft support member 14, and the sliding portion between the movable base plate 40 and the first fixed wall 69 of the fixed scroll member 31, thus appropriately lubricating the sliding portions.

(5) The filter 61 is placed at the opening 60*b* of the fixed passage 60 in the reservoir space 52*a*. Accordingly, foreign substances in the reservoir space 52*a* are prevented from being introduced into the fixed passage 60, and also prevented from being introduced, for example, into the sliding portion between the movable base plate 40 and the first fixed wall 69 of the fixed scroll member 31, the sliding portion between the movable base plate 40 and the disc-shaped portion 16 of the shaft support member 14, or the like. Thus, the front surface 40*a* and the back surface 40*b* of the movable base plate 40, the end surface 69*a* of the first fixed wall 69, the back surface 16*a* of the disc-shaped portion 16 and the like are prevented from being damaged by foreign substances.

(6) Carbon dioxide is employed as refrigerant for the refrigerant circuit. The present invention is particularly efficient in carbon dioxide refrigerant in which large thrust force is applied to the movable scroll member 38.

The present invention is not limited to the embodiments described above but may be modified into the following alternative embodiments.

In an alternative embodiment to the above preferred embodiment, the bleed passage 57 is omitted. In this case, a decrease in the pressure in the back pressure chamber 56 is achieved by the leakage of refrigerant gas from the inner tip seal 66 or the outer tip seal 67. Alternatively, one of the inner tip seal 66 and the outer tip seal 67 is omitted, and refrigerant gas in the back pressure chamber 56 is leaked through the clearance at the sliding portion between the back surface 40*b* of the movable base plate 40 and the back surface 16*a* of the disc-shaped portion 16 of the shaft support member 14. Furthennore, in at least one of the inner tip seal 66 and the outer tip seal 67, sealing performance is partially decreased by forming a notch, and refrigerant gas is leaked from the back pressure chamber 56 through the portion that is decreased in sealing performance. Anyway, a path through which refrigerant gas is bled from the back pressure chamber 56 may be regarded as a bleed passage.

In the preferred embodiment, the high-pressure refrigerant gas is introduced from the discharge chamber 52 into the back pressure chamber 56 through the reservoir space 52*a*. In an alternative embodiment, the high-pressure refrigerant gas is introduced from the upper side of the discharge chamber 52 (the region other than the reservoir space 52*a*) to the back pressure chamber 56, or is introduced from the discharge port 31*a* to the back pressure chamber 56, or is introduced from the compression chamber 47 that is in a discharge process (the compression chamber 47 that is in communication with the discharge port 31*a*) to the back pressure chamber 56. Additionally, the high-pressure refrigerant gas is introduced from an external conduit that communicates with, for example, the outlet 53, to the back pressure chamber 56.

In the preferred embodiment, the first fixed wall 69 is exclusively provided for the supply passage in the fixed scroll member 31 and independently from the fixed base plate 32 and the fixed scroll wall 34. However, the structure is not limited. In an alternative embodiment, the first fixed wall 69 is omitted, and the fixed base plate 32 doubles as the first fixed wall (the former), or the fixed scroll wall 34 doubles as the first fixed wall (the latter). Thus, in comparison to the structure that the first fixed wall is provided exclusively for the supply passage, the structure of the fixed scroll member 31 is simplified.

In the former case, the supply passage passes through the sliding portion between the front surface 32*a* of the fixed base plate 32 of the fixed scroll member 31 and, for example, the distal end surface of the movable scroll wall 41 of the movable scroll member 38. Also, in the latter case, the supply passage passes through the sliding portion between the distal end surface of the fixed scroll wall 34 of the fixed scroll member 31 and the front surface 40*a* of the movable base plate 40 of the movable scroll member 38.

It is noted that in the former case, a wall (a wall other than the movable scroll wall 41) is provided exclusively for the supply passage on the front surface 40*a* of the movable base plate 40, and the supply passage passes through the sliding portion between the end surface of the wall and the front surface 32*a* of the fixed base plate 32.

In the preferred embodiment, the first fixed wall 69 is provided for the fixed scroll member 31. However, it is not limited. In an alternative embodiment, for example, a member corresponding to the first fixed wall 69 is provided independently from the fixed scroll member 31.

In an alternative embodiment to the preferred embodiment, the hole 15*a* is isolated from the motor chamber 22 to use the isolated space as the back pressure chamber by placing a seal member in the boss 15 of the shaft support member 14 for sealing the rotary shaft 18. In this case, the portion corresponding to the bleed passage 57 and the back pressure chamber 56 is regarded as a part of the supply passage by omitting the fixed throttle 57*c* from the bleed passage 57 in the preferred embodiment. Also, in this case, a bleed passage having a fixed throttle may, for example, be provided for the shaft support member 14 so as to connect the above isolated space to the suction pressure region (for example, the motor chamber 22 or the suction chamber 51).

In an alternative embodiment to the preferred embodiment, the suction port 39 is omitted, while the inlet 50 directly opens to the suction chamber 51. Then, the hole 15*a* of the boss 15 of the shaft support member 14 is used as a back pressure chamber. Accordingly, the motor chamber 22 that communicates with the hole 15*a* is an atmosphere of the pressure in the back pressure chamber. In this case, the portion corresponding to the bleed passage 57 and the back pressure chamber 56 is regarded as a part of the supply passage by omitting the fixed throttle 57*c* from the bleed passage 57 in the preferred embodiment. Also, in this case, for example, a bleed passage having a fixed throttle may be provided for the shaft support member 14 so as to connect the motor chamber 22 to the suction pressure region (for example, the suction chamber 51).

In the preferred embodiment, the self-rotation blocking mechanism 48 includes the pin 48*a* fixed to the movable base plate 40, the pin 48*b* fixed to the fixed base plate 32, and the ring 48*c* arranged outside the pins 48*a*, 48*b*. However, it is not limited. In an alternative embodiment, a pin is fixed to the front surface 40*a* of the movable base plate 40, while a circular recess for guiding the orbital motion of the pin is formed in the front surface 32*a* of the fixed base plate 32.

In the preferred embodiment, the self-rotation blocking mechanisms 48 are provided between the movable base plate 40 and the fixed base plate 32. In an alternative embodiment, the self-rotation blocking mechanisms 48 are provided between the movable base plate 40 and the disc-shaped portion 16 of the shaft support member 14. In this case, the back pressure chamber 56 is formed to avoid the self-rotation blocking mechanism 48.

The present invention is not limited to a motor compressor, that is, a scroll type compressor that only employs an electric motor as a drive source, but may be a scroll type compressor that employs a vehicular engine as a drive source or a hybrid scroll type compressor that employs an electric motor and an engine as a drive source.

The present invention may be applied to a scroll type compressor for a refrigerant circuit employing fluorocarbon refrigerant.

The present invention may be applied to, for example, an air compressor used for other than a refrigerant circuit.

Therefore, the present examples and embodiments are to be considered as illustrative and not restrictive, and the invention is not to be limited to the details given herein but may be modified within the scope of the appended claims.

What is claimed is:

1. A scroll type compressor comprising:

a housing defining a discharge pressure region;

a fixed scroll member having a fixed base plate and a fixed scroll wall extending from a surface of the fixed base plate;

a movable scroll member having a movable base plate and a movable scroll wall extending from a surface of the movable base plate, the movable scroll wall being engaged with the fixed scroll wall, the fixed scroll member and the movable scroll member being arranged in the housing and defining therebetween a compression chamber, which moves radially and inwardly to progressively reduce the volume of the compression chamber for compressing gas by orbital motion of the movable scroll member;

a first fixed wall provided in the housing for slidably supporting a surface of the movable scroll member;

a back pressure chamber defined on a back surface side of the movable base plate in the housing; and a supply passage connecting the back pressure chamber to the discharge pressure region and passing through a sliding portion between the movable scroll member and the first fixed wall, wherein a clearance at the sliding portion varies in response to a position of the movable scroll member in a direction in which the movable scroll member approaches to or leaves from the first fixed wall, whereby cross-sectional area of the clearance where the gas passes is varied to adjust pressure in the back pressure chamber, the supply passage including a fixed passage, a communication recess and a movable passage, the communication recess and a region of an opening of the movable passage respectively functioning as a valve seat and a valve portion to open and close the supply passage.

2. The scroll type compressor according to claim 1, wherein the surface of the movable scroll member is a front surface of the movable base plate, the first fixed wall is provided on the surface of the fixed base plate and is located at a position that is different from the fixed scroll wall.

3. The scroll type compressor according to claim 1, further comprising:

a second fixed wall provided in the housing for slidably supporting a back surface of the movable base plate, the movable base plate and the second fixed wall defining therebetween the back pressure chamber.

4. The scroll type compressor according to claim 3, further comprising:

a self-rotation blocking mechanism provided between the movable base plate and the fixed base plate for blocking self-rotation of the movable scroll member, while allowing orbital motion of the movable scroll member.

5. The scroll type compressor according to claim 1, further comprising:

an oil separator provided in the housing for separating lubricating oil from the gas discharged from the compression chamber; and a reservoir space provided in the housing for reserving the lubricating oil separated by the oil separator, wherein the reservoir space is a part of the discharge pressure region and is in communication with the back pressure chamber through the supply passage.

6. The scroll type compressor according to claim 5, further comprising:

a filter placed at an opening of the supply passage in the reservoir space.

7. The scroll type compressor according to claim 5, wherein the lubricating oil is introduced together with high-pressure refrigerant gas from a region around a lowermost portion of the discharge pressure region to the back pressure chamber.

8. The scroll type compressor according to claim 1, wherein the gas is refrigerant for a refrigerant circuit, carbon dioxide being employed as the refrigerant.

9. The scroll type compressor according to claim 1, wherein the scroll type compressor is driven by an electric motor.

10. The scroll type compressor according to claim 1, wherein the first fixed wall is integrally formed with the fixed scroll member.

11. The scroll type compressor according to claim 1, wherein the communication recess and the movable passage are continuously communicated with each other.

12. The scroll type compressor according to claim 1, wherein the housing further defines a suction pressure region, the suction pressure region and the back pressure chamber being communicated with each other through a bleed passage, wherein a throttle is provided between an opening of the bleed passage and the suction pressure region.

13. A scroll type compressor comprising:

a housing defining a discharge pressure region;

a fixed scroll member having a fixed base plate and a fixed scroll wall extending from a surface of the fixed base plate;

a movable scroll member having a movable base plate and a movable scroll wall extending from a surface of the movable base plate, the movable scroll wall being engaged with the fixed scroll wall, the fixed scroll member and the movable scroll member being arranged in the housing and defining therebetween a compression chamber, which moves radially and inwardly to progressively reduce the volume of the compression chamber for compressing gas by orbital motion of the movable scroll member;

a first fixed wall provided on the surface of the fixed base plate for slidably supporting a surface of the movable base plate, the first fixed wall being located radially outside the fixed scroll wall;

a back pressure chamber defined on a back surface side of the movable base plate in the housing; and a supply passage connecting the back pressure chamber to the discharge pressure region and passing through a sliding portion between the surface of the movable base plate and the first fixed wall, wherein a clearance at the sliding portion varies in response to a position of the movable scroll member in a direction in which the movable scroll member approaches to or leaves from the first fixed wall, whereby cross-sectional area of the clearance where the gas passes is varied to adjust the pressure in the back pressure chamber.

14. A scroll type compressor comprising:

a housing defining a discharge pressure region;

a fixed scroll member having a fixed base plate and a fixed scroll wall extending from a surface of the fixed base plate;

a movable scroll member having a movable base plate and a movable scroll wall extending from a surface of the movable base plate, the movable scroll wall being engaged with the fixed scroll wall, the fixed scroll member and the movable scroll member being arranged in the housing and defining therebetween a compression chamber, which moves radially and inwardly to progressively reduce the volume of the compression chamber for compressing gas by orbital motion of the movable scroll member;

a first fixed wall provided in the housing in the housing for slidably supporting a surface of the movable scroll member;

a back pressure chamber defined on a back surface side of the movable base plate in the housing;

a supply passage connecting the back pressure chamber to the discharge pressure region and passing through a sliding portion between the movable base member and the first fixed wall, wherein a clearance at the sliding portion varies in response to a position of the movable scroll member in a direction in which the movable scroll member approaches to or leaves from the first fixed wall, whereby cross-sectional area of the clearance where the gas passes is varied to adjust pressure in the back pressure chamber;

an oil separator provided in the housing for separating lubricating oil from the gas discharged from the compression chamber;

a reservoir space provided in the housing for reserving the lubricating oil separated by the oil separator, wherein the reservoir space is a part of the discharge pressure region and is in communication with the back pressure chamber through the supply passage; and a filter placed at an opening of the supply passage in the reservoir space.

* * * * *

UNITED STATES PATENT AND TRADEMARK OFFICE

CERTIFICATE OF CORRECTION

PATENT NO. : 7,195,470 B2
APPLICATION NO. : 11/015996
DATED : March 27, 2007
INVENTOR(S) : Kazuya Kimura et al.

It is certified that error appears in the above-identified patent and that said Letters Patent is hereby corrected as shown below:

In the Specification

Column 2, line 44, please delete "comprising" and insert therefore -- comprises --;

Column 4, line 42, please delete "Accordingly, The" and insert therefore -- Accordingly, the --;

Column 5, line 14, please delete "port 31 a" and insert therefore -- port 31a --; and Column 10, line 49, please delete "Furthennore," and insert therefore -- Furthermore, --.

In the Claims

In Claim 14, Column 14, line 35, please delete "in the housing in the housing" and insert therefore -- in the housing --.

Signed and Sealed this

Eighth Day of December, 2009

David J. Kappos

David J. Kappos
*Director of the United States Patent and Trademark Office*